US005198618A

United States Patent [19]

Shieh

[11] Patent Number: 5,198,618

[45] Date of Patent: Mar. 30, 1993

[54] SAFETY COVER PLATE FOR AN ELECTRICAL SOCKET

[76] Inventor: Gary Shieh, 9-4F, No. 106, Sec. 3, Hsin-I Rd., Taipei City, Taiwan

[21] Appl. No.: 832,917

[22] Filed: Feb. 10, 1992

[51] Int. Cl.[5] ..... H01R 13/453

[52] U.S. Cl. ..... 174/67; 439/137

[58] Field of Search ..... 174/67; 220/242; 439/135, 136, 137, 140

[56] References Cited

U.S. PATENT DOCUMENTS

| | | | |
|---|---|---|---|
| 783,653 | 2/1905 | Tregoning | 439/140 X |
| 2,820,842 | 1/1958 | Meistrell | 174/67 |
| 4,109,095 | 8/1978 | Kling et al. | 174/67 |
| 4,293,733 | 10/1981 | Royer | 174/67 |
| 4,798,916 | 1/1989 | Engel et al. | 174/67 |

*Primary Examiner*—Leo P. Picard
*Assistant Examiner*—David Tone
*Attorney, Agent, or Firm*—Ratner & Prestia

[57] ABSTRACT

A safety cover plate for covering an electric socket includes an external plate member with an opening aligned with the receptacle. The sliding plates are slidably mounted to the inside of the external plate member to shield the opening of the external plate member. A biasing member is provided to urge the sliding plates to engage and shield the opening. The sliding plates are mounted between two rails. A notch misaligned with the slots of the receptacle is formed on one of the sliding plates so that a user can separate the two sliding plates from each other and insert a plug into the receptacle.

6 Claims, 7 Drawing Sheets

SAFETY COVER PLATE FOR AN ELECTRICAL SOCKET

BACKGROUND OF THE INVENTION

1. Field of the Invention

This invention relates to a safety cover plate for covering an electrical socket, more particularly to a safety cover plate for covering a wall socket which can protect children from accidental electric shock.

2. Description of the Related Art

Conventionally, electrical sockets have been widely used in houses. Referring to FIG. 1, a conventional wall socket comprises an outlet box (A) to be mounted in a wall, receptacles (B) to be received in the outlet box (A) and a cover plate (C) with two openings (C1). The two receptacles (B) with slots (B1), (B2) are respectively aligned with the two openings (Cl) of the cover plate (C) so that the receptacles (B) can be exposed to the outside and the slots (B1), (B2) can be inserted with plugs (not shown). However, children in a house are likely to insert a conductor such as a metal spoon or hair clip, into the electrical socket for fun, thereby receiving an electric shock, since there is no shielding device on electrical sockets to keep children away from touch of the slots (B1), (B2) of the receptacle (B). In addition, it is possible for a child to be shocked by touching partially inserted blades of a plug if the plug is not properly inserted into the receptacle (B). There have been improved wall sockets having shielding devices designed to protect children from being shocked. But, the costs for providing such a wall socket which can prevent children from being accidentally shocked are higher because a new wall socket is needed to replace a conventional wall socket without shielding devices rather than just replacing the cover plate of the conventional socket with an improved cover plate. Furthermore, the installation of these improved wall sockets must be done by a man skilled in the art.

SUMMARY OF THE INVENTION

It is therefore an object of this invention to provide a safety cover plate of a wall socket which can protect children from accidental shock, even if a plug is not properly inserted in the receptacle.

It is another object of this invention to provide a safety cover plate of a wall socket which can be used with a conventional receptacle in order to reduce the costs, the installation of which is so easy and simple that can be done by a user who is not skilled in the art.

Accordingly, the safety cover plate for covering a wall socket includes an external plate member having a first opening aligned with a receptacle of the wall socket. A first and a second rail parallel to each other are provided on the inside face of said external plate member. The first opening is located between said first and second rails. A discontinuous intermediate section is formed in the second rail.

A gear assembly is mounted to the inside face of the external plate member adjacent to the discontinuous intermediate section of the second rail. The gear assembly has a first and a second gear rotated in opposite directions.

A pair of sliding plates are slidably mounted between the first and second rails. Each of the sliding plates has a toothed edge adjacent to the discontinuous intermediate section so that the toothed edges of the sliding plates can respectively mesh the first and second gears. The sliding plates shield the first opening of the external plate member when they engage each other and expose the first opening of the external plate member when they are moved away from each other. A notch is formed on the engaging edges which are sealed in contact with each other when the sliding plates engage to shield the first opening. The notch is staggered with the slots of the receptacle when the sliding plates engage each other.

A biasing means is provided on the inside face of the external plate member for biasing the sliding plates to engage each other.

An internal plate member is detachably connected to the first and second rails which cooperates with the external plate member and the first and second rails to hold the sliding plates in position.

Therefore, the receptacles of the wall socket can be shielded by the sliding plates of the safety cover plate of this invention when said safety cover plate is mounted to the outlet box in a conventional manner. The user can separate the sliding plates from each other so as to expose the slots of the receptacle in order to insert the blades of a plug into the slots of the receptacle by inserting one of said blades into the notch on the engaging edges of the sliding plates, pushing one of said sliding plates away from the other one of said sliding plates by means of the gear assembly and inserting said blades into said slots.

In addition, a tubular member is detachably mounted on the outside face of the external plate member so as to form a wall around the first opening of the external plate member. Therefore, the partially inserted blades of a plug in the wall socket will not be touched by the children.

BRIEF DESCRIPTION OF THE DRAWINGS

Other features and advantages of this invention will become apparent in the following detailed description of the preferred embodiments of this invention with reference to the accompanying drawings, in which.

DETAILED DESCRIPTION OF THE PREFERRED EMBODIMENTS

Figure 1:
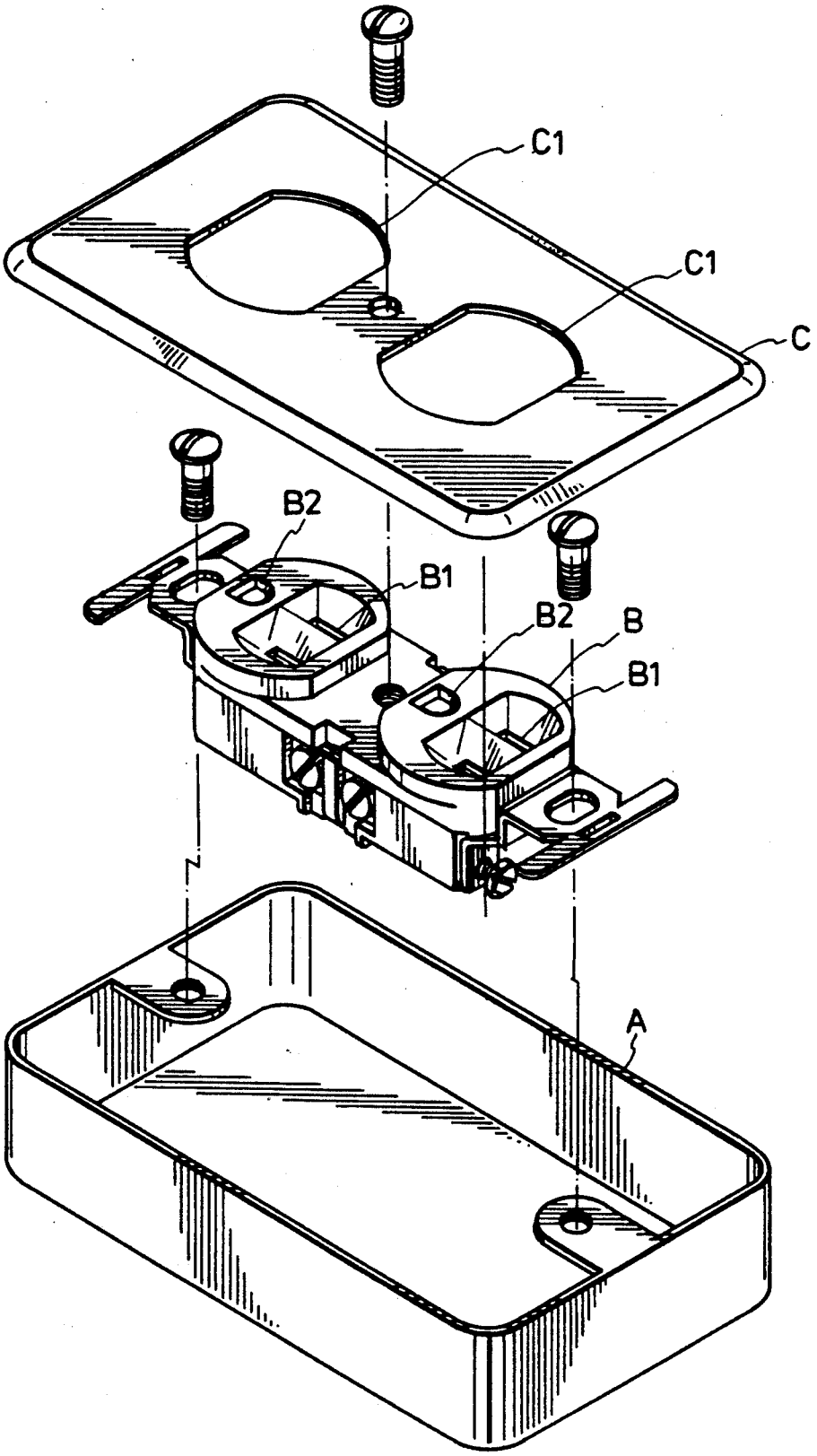
FIG. 1 (PRIOR ART)
FIG. 1 is a perspective exploded view of a conventional wall socket.
Figure 3:
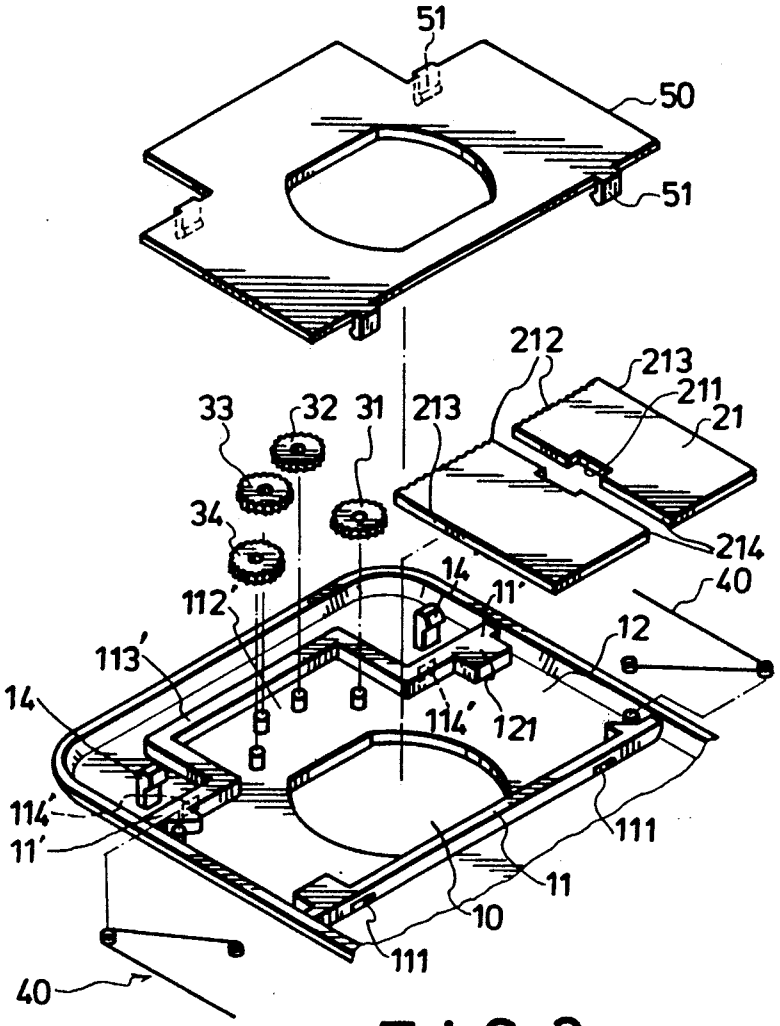
FIG. 3 is a partially perspective exploded view of the first preferred embodiment of a wall socket of this invention.
Figure 2:
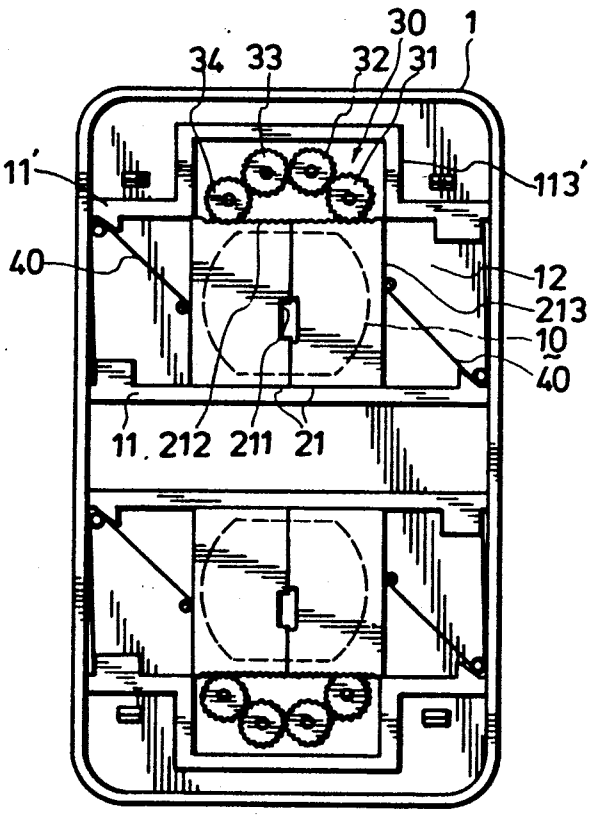
FIG. 2 is a rear plan view of a first preferred embodiment of a wall socket of this invention.

FIGS. 2 and 3 show a first preferred embodiment of a safety cover plate for covering a wall socket according to this invention. The safety cover plate includes an external plate member 1 having two first openings 10 formed thereon. The two first openings 10 are respectively aligned with the receptacles of the wall socket. Since the upper portion of the safety cover plate is similar to the lower portion of the safety cover plate as shown in FIG. 2, only the upper portion of the safety cover plate will be explained in detail hereinbelow for simplification. The inside face 12 of the external plate member 1 has a first and a second rail 11, 11' parallel to each other. The first opening 10 is located between the first and second rails 11, 11'. The second rail 11' has a discontinuous intermediate section 112' and a U-shaped rail 113', the two free ends of which are connected to the interrupted portions to form a continuous frame, as best illustrated in FIG. 3.

A gear assembly 30 is mounted to the inside face of the external plate member 1 adjacent to the discontinuous intermediate section 112' of the second rail 11'. The gear assembly 30 includes four gears 31, 32, 33 and 34 meshed with each other such that two end gears 31 and 34 are rotated in opposite directions.

Figure 5:
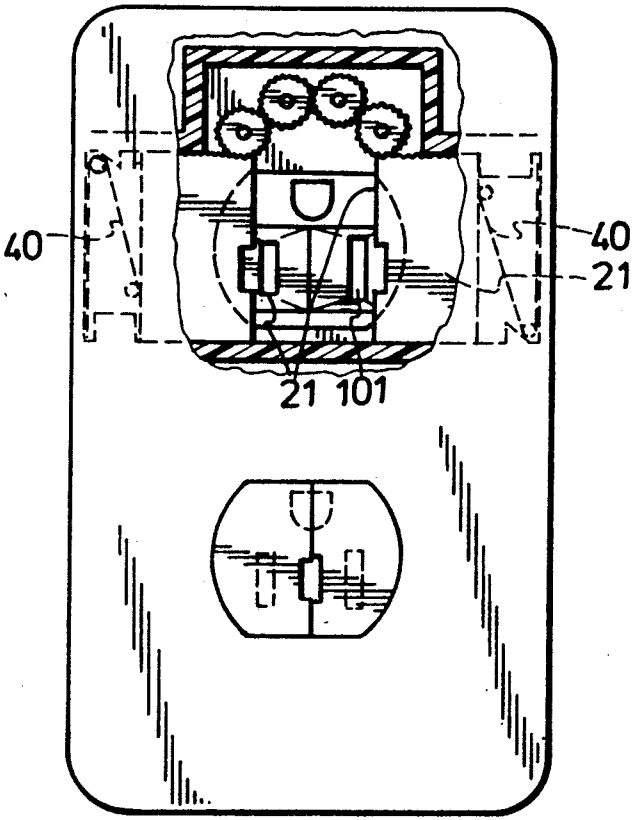
FIG. 5 is a partial sectional schematic view of the wall socket of this invention in which the sliding plates are in an open position.
Figure 4:
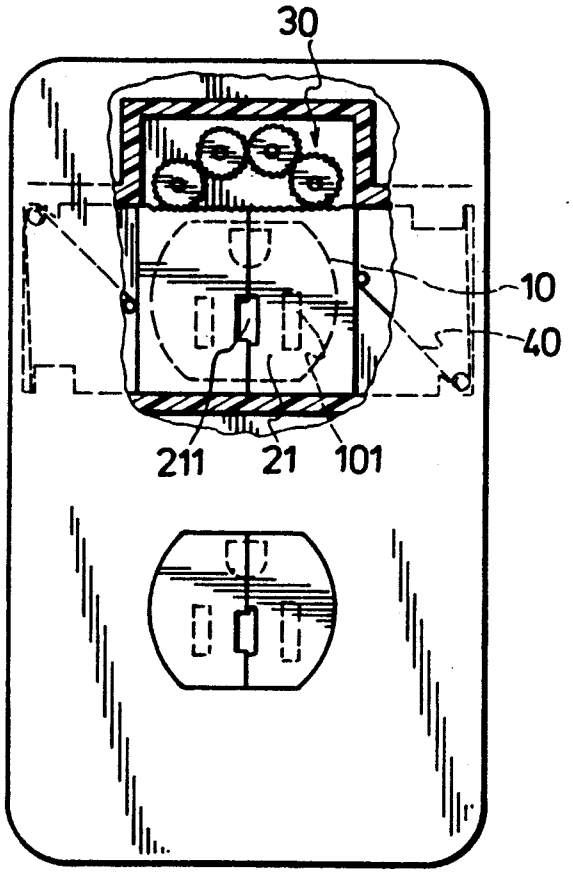
FIG. 4 is a partial sectional schematic view of the wall socket of this invention in which the sliding plates are in a closed position.

A pair of sliding plates 21 are slidably mounted between the first and second rails 11, 11'. Each of the sliding plates 21 has a toothed edge 212 which is adjacent to the discontinuous intermediate section 112' such that the toothed edges 212 of the sliding plates 21 can respectively mesh the end gears 31 and 34. Each of the sliding plates 21 has an engaging edge 214 which is sealed in contact with the other one of the engaging edges when the sliding plates engage so as to shield the first opening 10. Two opposed notches 211 are respectively formed on each of the engaging edges 214 to define a hole when the sliding plates 21 engage with each other. The hole defined by the opposed notches 211 is staggered with the slots 101 of the receptacle. Two torsional springs 40 are respectively mounted on the external plate member 1, biasing two opposite sides 213 of the sliding plates 21 to enable the engaging edges 214 to come into contact and to enable the hole defined by the opposed notches 211 to be located between the slots 101 of the receptacle, as best illustrated in FIG. 4. The sliding plates 21 shield the first opening 10 of the external plate member 1 when they engage each other, as best illustrated in FIG. 4. The first opening 10 of the external plate member 1 can be exposed by inserting one of the blades 91 of a plug 90 into the hole defined by the notches 211 and pushing one of the sliding plates 21 away from the other one of the sliding plates 21. The second of the sliding plates 21 is simultaneously and automatically moved away from the first of the sliding plates 21 when the latter is first moved by means of the gear assembly 30, as best illustrated in FIG. 5. Therefore, the blades 91 of the plug 90 may be inserted into the slots 101 of the receptacle. When the plug 90 is pulled out of the receptacle, the sliding plates 21 move toward each other and engage automatically by the biasing force exerted by the torsional springs 40 in order to shield the first opening 10 of the external plate 1. Since the hole defined by the notches 211 is misaligned with the slots 101 of the receptacle when the sliding plates engage, a child will not be accidentally shocked when he/she inserts a metal rod or clip into said hole formed on the sliding plates 21 which shield the first opening 10 of the external plate member 1.

An internal plate member 50 is detachably connected to the first and second rails 11, 11' by four snap hooks 51 which respectively engage with the slots 111 and 114' which are respectively formed on the first and second rails 11, 11'. The internal plate member 50 cooperates with the external plate member 1 and the first and second rails 11, 11' to hold the sliding plates 21, torsional spring 40 and gear assembly 30 in position. The safety cover plate of this invention can be replaced for conventional cover plate easily.

Figure 7A:
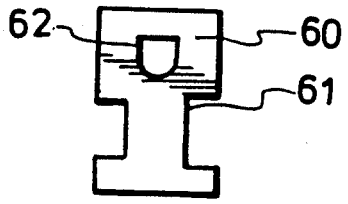
FIG. 7A is a planar view of an I-shaped supporting board which is used to hold the sliding plates in an open position.
Figure 6:
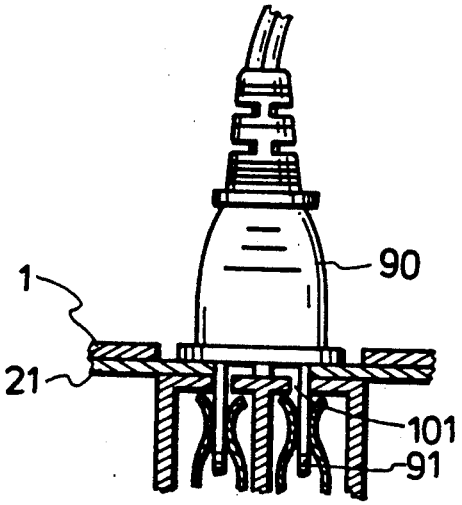
FIG. 6 is a partial sectional schematic view showing a plug inserted into the receptacle of the wall socket of this invention.
Figure 7:
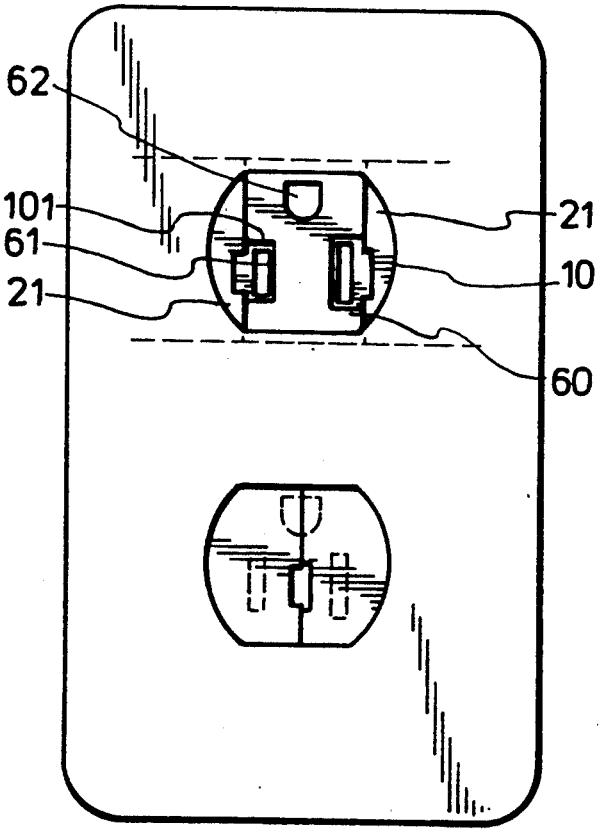
FIG. 7 is a schematic view showing the I-shaped supporting board in an operative position.

Referring to FIGS. 7A and 7, a generally I-shaped supporting board 60 may be detachably mounted to the first opening 10 of the external plate member 1 to separate the sliding plates 21. The supporting board 60 has two notches 61 and a hole 62 formed on two opposite sides thereof, exposing the slots 101 of the receptacle. Therefore, a plug can be inserted into the receptacle without hindrance when there are no children at home and no protective effects for the wall socket are required.

Figure 8:
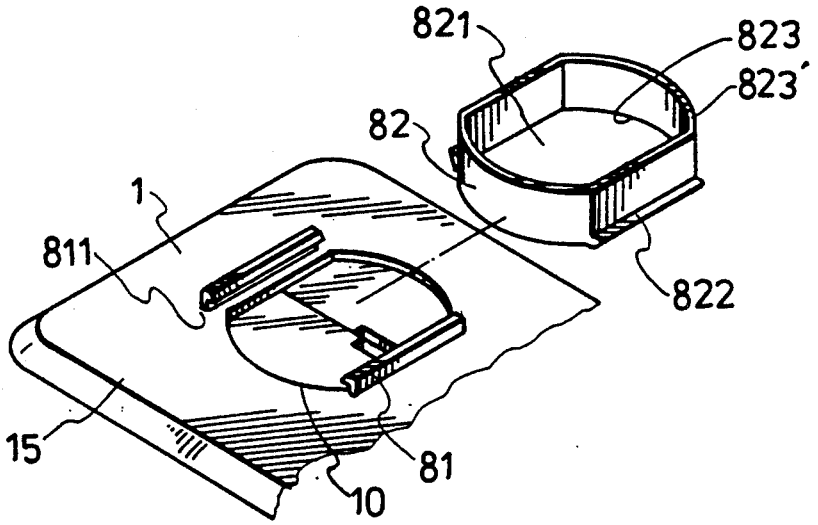
FIG. 8 is a partial perspective exploded view of a second preferred embodiment of a wall socket of this invention.
Figure 9:
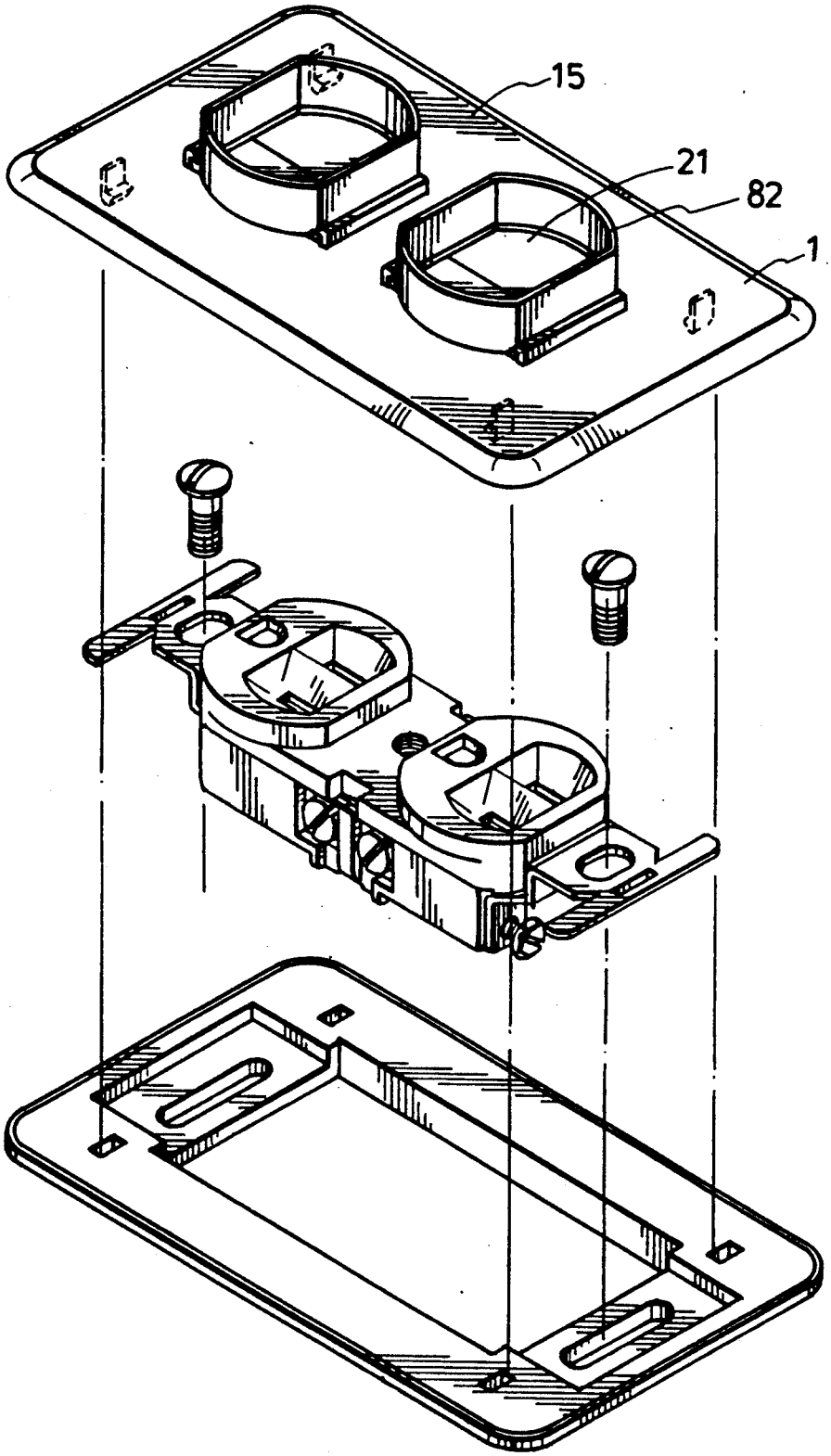
FIG. 9 is a perspective exploded view of the second preferred embodiment of a wall socket of this invention.

Referring to FIGS. 8 and 9, a second preferred embodiment of a safety cover plate of a wall socket of this invention is shown In this embodiment, the outside face 15 of the external plate member 1 has two rod members 81 respectively formed at two opposite sides of the first opening of the external plate member. Each of the rod members is an inverted L-shape in cross section and has a sliding groove 811 formed along its length. The two sliding grooves 811 face each other. A tubular member 82 is detachably mounted to the outside face 15 of the external plate member 1 to form a wall around the first opening 10 of the external plate member 1. The tubular member 82 has two open ends 823 and 823' and a hollow portion 821 aligned with the first opening 10 of the external plate member 1. One of the open ends 823 has two opposite outwardly extending flanges 822 respectively and slidably received in the two sliding grooves 811 of the rod members 81. Therefore, the partially inserted blades of a plug in the wall socket will be shielded by the tubular member and will not be touched by children.

Figure 10:
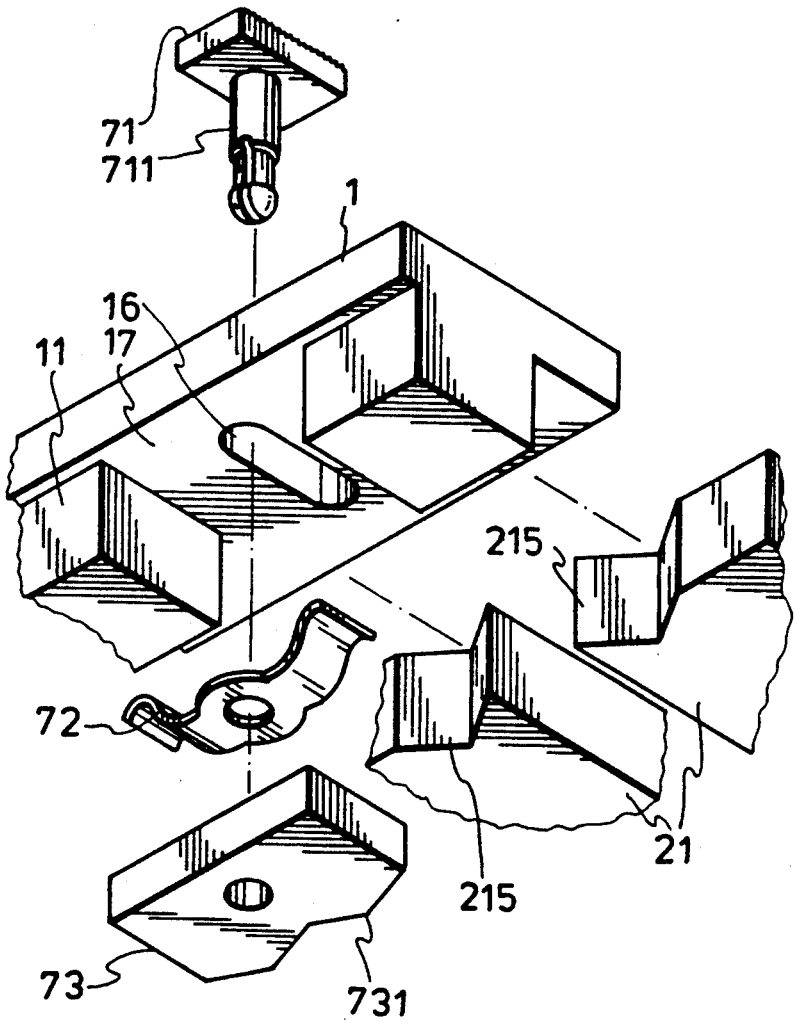
FIG. 10 is a partial perspective exploded view of a third preferred embodiment of a wall socket of this invention, showing a locking mechanism provided for locking the sliding plates.

Referring to FIG. 10, a third preferred embodiment of this invention is shown. In this embodiment, each of the sliding plates 21 has two notches 215 respectively formed on the pair of sliding plates adjacent to the first rail 11. A slider 71 with a positioning rod 711 is slidably mounted on the external plate member 1 near a notch 17 formed on the first rail 11. The positioning rod 711 of the slider 71 passes through an elongated slot 16 in the external plate member 1 and a positioning spring member 72 and is connected with a block member 73 with two teeth 731. Thus, the slider 71 can be moved between an open and a locked position where the teeth 73 of the block member 73 engage and disengage the notches 215 of the sliding plates 21, respectively. This lock mechanism provides an additional security to prevent the sliding plates from disengaging from each other by a smart child.

It can be found that an excellent protective effect can be achieved by replacing the conventional cover plate of a conventional wall socket with the safety cover plate of this invention by a user not skilled in the art. This reduces the costs of installation and use.

With this invention thus explained, it is apparent that numerous modifications and variations can be made without departing from the scope and spirit of this invention. It is therefore intended that this invention be limited only as indicated in the appended claims.

I claim:

1. A safety cover plate for covering an electrical socket having a receptacle with slots formed therein, comprising:

an external plate member having a first opening aligned with said receptacle, said external plate member having an outside face and an inside face adjacent to said receptacle, said inside face of said external plate member having a first and a second rail parallel to each other in such a manner that said first opening is located between said first and second rails, said second rail having a discontinuous intermediate section;

a gear assembly mounted to said inside face of said external plate member adjacent to said discontinuous intermediate section of said second rail, said gear assembly having a first and a second gear rotated in opposite directions;

a pair of sliding plates slidably mounted between said first and second rails, each of said sliding plates having a toothed edge adjacent to said discontinuous intermediate section so that said toothed edges of said sliding plates can respectively mesh said first and second gears, said sliding plates shielding said first opening of said external plate member when they engage each other and exposing said first opening of said external plate member when they are moved away from each other, each of said sliding plates having an engaging edge which sealingly contacts the other one of said engaging edges when said pair of sliding plates engage so as to shield said first opening, one of said engaging edges having a notch formed thereon, said notch being staggered with said slots of said receptacle when said sliding plates engage each other;

means for biasing said pair of sliding plates to engage each other so as to shield said first opening; and an internal plate member detachably connected to said first and second rails which cooperates with said external plate member and said first and second rails to hold said pair of sliding plates in position.

2. A safety cover plate for covering an electric socket as claimed in claim 1, further comprising a generally I-shaped supporting board detachably mounted to said first opening of said external plate member to separate said pair of sliding plates, said supporting board having two notches formed on two opposite sides thereof, exposing said slots of said receptacle.

3. A safety cover plate for covering an electric socket as claimed in claim 1, wherein said outside face of said external plate member has a tubular member detachably mounted to said outside face of said external plate member to form a wall around said first opening of said external plate member, and means for detachably fastening said tubular member to said external plate member.

4. A safety cover plate for covering an electric socket as claimed in claim 3, wherein said fastening means includes two rod members respectively formed at two opposite sides of said first opening of said external plate member, each of said rod members having a sliding groove formed along its length, said two sliding grooves facing each other, said tubular member having two open ends and a hollow portion aligned with said first opening of said external plate member, one of said open ends having two opposite outwardly extending flanges respectively and slidably received in said two sliding grooves of said rod members.

5. A safety cover plate for covering an electric socket as claimed in claim 1, wherein each of said sliding plates has a first lock member formed on an edge opposite to said toothed edge of said sliding plates adjacent to said engaging edges of said sliding plates, and wherein said external plate member has a second lock member mounted adjacent to said first rail, said first and second lock members locked to prevent said pair of sliding plates from disengaging from each other when said sliding plates engage with each other.

6. A safety cover plate for covering an electric socket as claimed in claim 5, wherein said first lock members are two notches respectively formed on said pair of sliding plates and said second lock member includes a slider slidably mounted on said external plate member near a notch formed in said first rail, which moves between an open and a locked position, and a block member with two teeth connected to said slider, said teeth of said block member being engaged with said notches of said sliding plates when said slider is moved to said locked position.

* * * * *